US005392579A

United States Patent [19]

Champagne

[11] Patent Number: 5,392,579

[45] Date of Patent: Feb. 28, 1995

[54] LIPLESS CLIP FOR VINYL SIDING AND METHOD

[76] Inventor: Charles A. Champagne, 15607 S. Chanpagne Cir., Houston, Tex. 77377

[21] Appl. No.: 121,023

[22] Filed: Sep. 13, 1993

[51] Int. Cl.[6] ..... E04D 1/34

[52] U.S. Cl. ..... 52/520; 52/545; 52/546; 52/547

[58] Field of Search ..... 52/520 OR, 545, 546, 52/547, 552

[56] References Cited

U.S. PATENT DOCUMENTS

| | | | |
|---|---|---|---|
| 3,738,076 | 6/1973 | Kessler | 52/547 |
| 3,757,483 | 9/1973 | Torbett | 52/545 |
| 3,824,756 | 7/1974 | Kessler | 52/546 |
| 4,424,655 | 1/1984 | Trostle | 52/547 |
| 4,947,609 | 8/1990 | Champagne | 52/545 |
| 5,339,608 | 8/1994 | Hollis et al. | 52/520 |

*Primary Examiner*—Carl Friedman
*Assistant Examiner*—Wynn E. Wood
*Attorney, Agent, or Firm*—Jack W. Hayden

[57] ABSTRACT

A clip (5) is formed of strip metal or material C for engaging with an upper most panel (UP) of a building siding (25) and a top out panel (P) to secure the top out panel (P) in position between the uppermost panel (UP) and the soffit (S) of building siding (25).

2 Claims, 2 Drawing Sheets

LIPLESS CLIP FOR VINYL SIDING AND METHOD

STATEMENT OF THE PRIOR ART

Various types of clips have been proposed and are in use in an effort to secure a vinyl top out panel between the upper most building siding panel and the soffit. My prior U.S. Pat. No. 4,947,609 solved part of the problem in that it provided a clip structure to secure the top out panel as desired.

However it has drawbacks in that it requires that it be folded to position it on the uppermost panel. It also employs a shoulder, or lip, to support the top out panel, and this shoulder, or lip, is exposed at the front of the top out panel which, when its color does not match the color of the top out panel requires that it be painted to match the exposed and visible surface of the top out panel.

Further, a hammer or tool may be required to bend the shoulder, or lip, to attain a flush appearance with the top out panel.

Additionally the throat of the top out panel generally must be opened, or enlarged to receive the clip.

Since the clips are spaced along the upper most upper panel generally about every 18 inches to 28 inches, it can be appreciated that all of the above procedures require additional time, effort and tools which increase the difficulty and cost of installation of the vinyl top out panel.

SUMMARY OF THE INVENTION

An object of the present invention is to provide a clip for securing vinyl top out panels between the soffit and the upper most building siding panel which eliminates all of the above problems and disadvantages of the clip in my prior patent above referred to.

A further object is to provide a clip for installing vinyl top out panels between the upper most panel of a building siding and the soffit which is invisible when installed. It therefor does not require any painting, or bending or shaping after installation. It does not require any bending or shaping before installing, and it does not require any of the other pre or post installation procedures required by the clip of my prior patent above identified.

Yet a further object of the invention is to provide a method for quickly and easily securing building siding top out panels between an upper most siding panel and a soffit.

Another object of the present invention is to provide a clip and method of installing a vinyl top out panel wherein the clip may be secured to the upper most panel that is secured to the building wall and the top out panel then engaged with the clip, or a plurality of the clips may be engaged with the upper most panel at desired spaced intervals there along and the panel and the clips thereon secured with the building siding and then the top out panel engaged with the clip.

Yet a further object of the invention is to provide an arrangment for quickly and easily securing building siding top out panels between an upper most siding panel and a soffit.

DESCRIPTION OF THE PREFERRED EMBODIMENT

The clip of the present invention is preferably formed of a strip of stainless steel, but it may be formed of any suitable metal or material, such as by way of example only and not by way of limitation, any metal or synthetic that substantially exhibits the characteristics of stainless steel. It can be of any suitable length desired, and a length of approximately 3 and $\frac{1}{4}$" works satisfactorily. The width may be approximately $\frac{3}{4}$ of an inch, but this also can be varied as desired. The thickness may vary, and by way of example only, the thickness may be approximately 0.022 to 0.024 inches.

Figure 4:
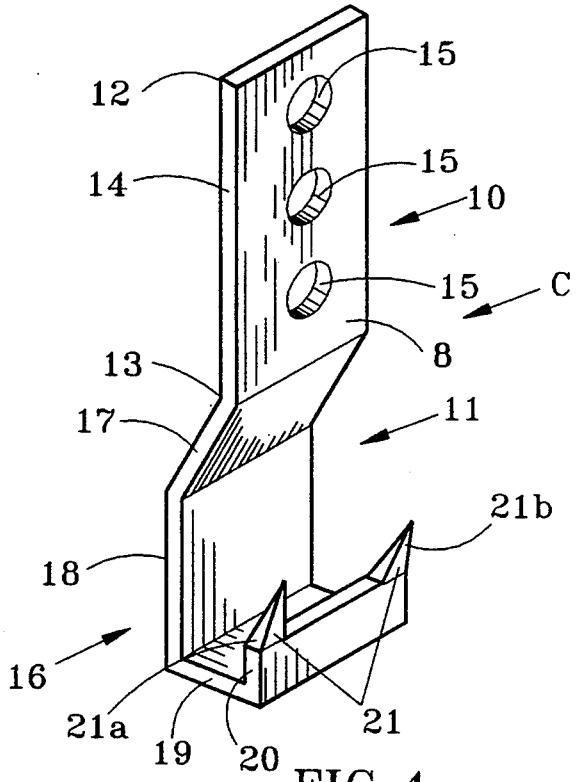
FIG. 4 is a perspective view of the preferred embodiment of the clip of the present invention.
Figure 5:
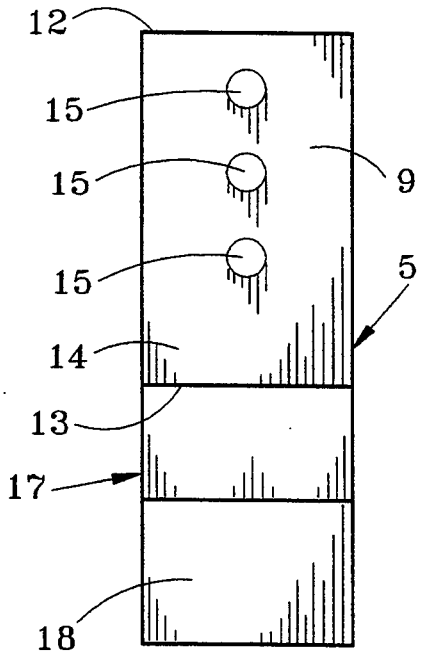
FIG. 5 is a back elevation of the preferred embodiment of the clip of the present invention.
Figure 6:
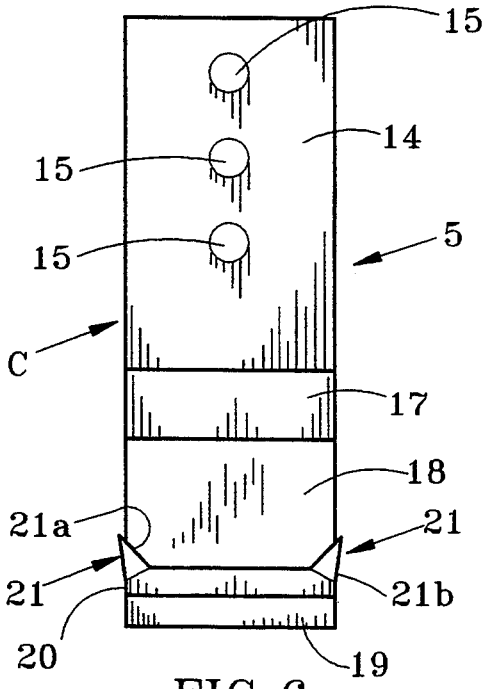
FIG. 6 is a back elevation of the preferred embodiment of the clip of the present invention.
Figure 7:
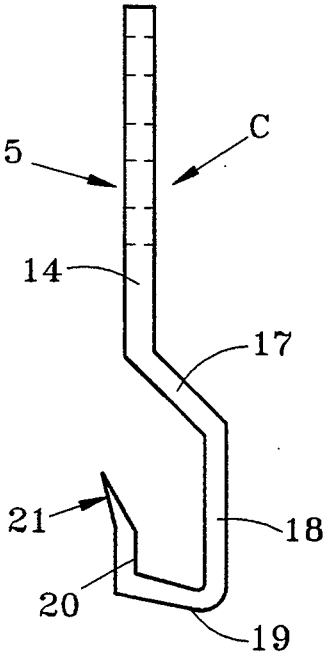
FIG. 7 is a side view of the of the preferred embodiment of the clip of the present invention.

Attention is first directed to FIGS. 4–7 of the drawings wherein the preferred form of the clip of the present invention is shown and is represented generally at 5. The clip C is formed of strip material C as shown and above described which provides a front surface 8 and a back surface 9 as illustrated in FIGS. 4 and 5, respectively.

The clip includes an upper portion and a lower portion referred to generally at 10 and 11, respectively. The upper portion 10 has an upper end 12 and a lower end 13 that defines an end portion 14 which has at least one, and is shown with three openings therein as represented at 15. Suitable securing means, such as nail 15', by way of example only and not by way of limitation, may be employed for securing the clip 5 to the building siding when the top out panel is to be installed as will be described in detail hereinafter.

The lower portion 11 of the clip may be considered as comprising the upwardly facing channel referred to generally at 16. The upwardly facing channel 16 may be formed in any suitable configuration to accomplish the desired results as hereinafter described and is illustrated, by way of example only, as being formed by the outwardly extending surface, or portion, 17 which also extends rearward relative to the front surface, or portion, 8 of the strip of material from which the clip 5 is formed, the downwardly extending surface, or portion, 18, the inwardly extending surface, or portion, 19 and the upwardly extending surface, or portion, 20. The above surfaces, or portions, are contiguous since they are formed, or stamped, preferably, from the same strip.

Snare means referred to generally at 21 are provided on the clip 5 to engage with the top out panel P and secure it with the clip to install the top out panel P between the upper most panel UP and the soffit S, as will be described in detail hereinafter. The snare means 21 are shown as comprising a pair of prongs, or projections, or sharp pointed members 21*a*,21*b* on the upper end surface of the upwardly extending surface 20 of the upwardly facing channel 16 which snare or engage the top out panel as will be described to secure it in position between the uppermost panel up and the soffit S. The snare means 21 may be placed anywhere on the clip 5 to effect snaring or engaging the top out panel P and secure it with the clip 5. The snare means may take any form or configuration which will accomplish the desired result of engaging the top out panel P to secure it in position between the upper most panel UP and the soffit S.

Figure 1:
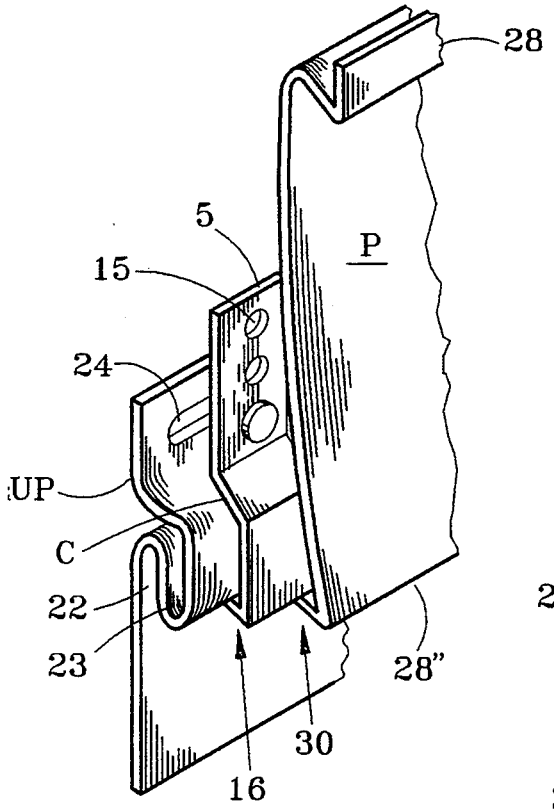
FIG. 1 is a partially exploded assembled view of the top out panel, the clip of the present invention and the upper most panel of the building siding.
Figure 2:
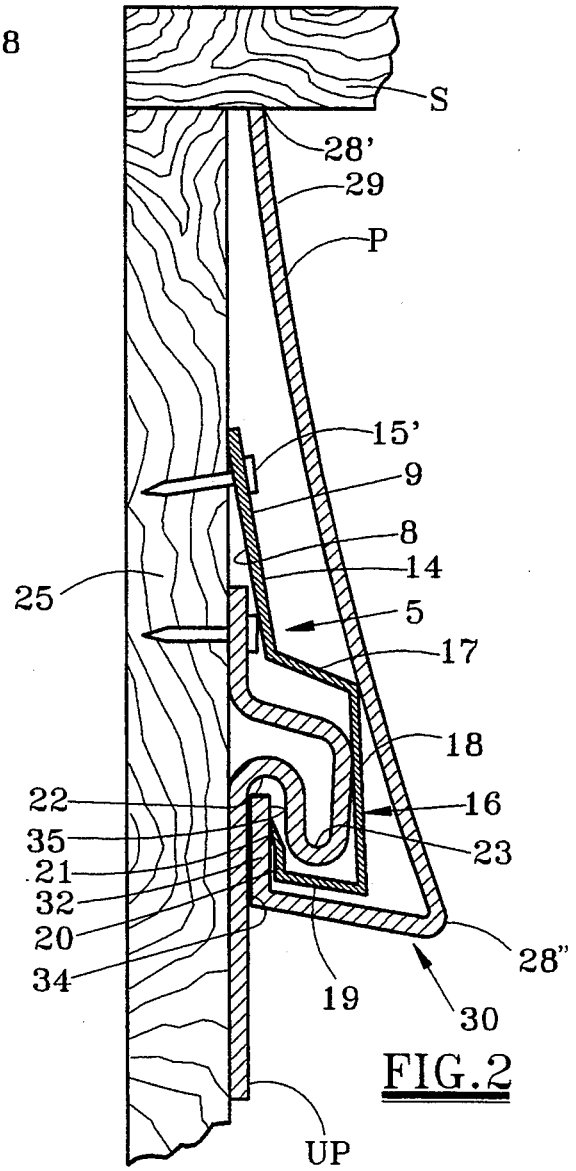
FIG. 2 is a side sectional view showing the building siding and soffit with the upper most panel secured to the building siding; the clip of the present invention secured to the building siding and engaged with the uppermost panel, and shows the top out panel secured in position between the soffit and the upper most panel by the clip of the present invention.
Figure 3:
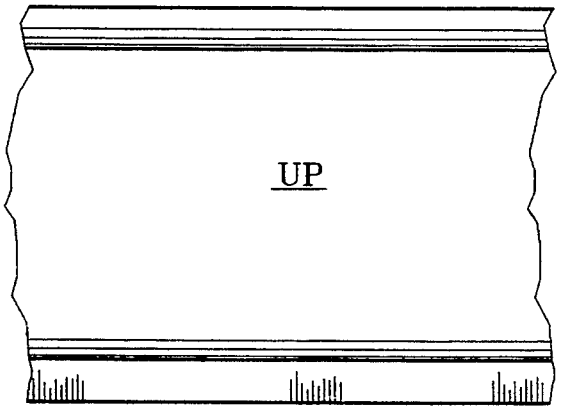
FIG. 3 is a front elevation of a portion of the longitudinally extending upper most building panel.

The next to top, or upper most panel UP, is formed to have a downwardly facing channel 22 and an upwardly facing channel 23 as shown in FIG. 1 of the drawings. It also has slots, or openings 24 to receive securing; means, such as nails to secure it, as shown in FIG. 2, with the building siding represented at 25. siding as generally illustrated in FIG. 2 of the drawings. A trim (not shown) may be placed externally, or outwardly, of the upper end 28 of the top out panel P, as is well known in the art. The nornal top out panel upper end shown at 28 in FIG. 1 is generally cut off as illustrated by the upper edge 28' in FIG. 2 of the drawings to fit the top out panel between the next to last panel which is the upper most panel UP and the soffit S and thereby complete the vinyl covering on the building siding 25 between the upper most panel UP and the soffit.

Generally speaking, the upper most panel has heretofore been secured to the building siding before a clip was secured therewith; however, the uniqueness of the clip of the present invention may enable the clip of the present invention to be installed along the longitudinal extent of the upper most panel, if desired, and to then secure the upper most panel and the clip to the building siding.

Where the vinyl panels have been secured on the building siding in a manner well known in the art the building siding between the next to last, or uppermost, panel and the soffit S is then provided with the top out panel P.

The top out panel P includes the upper edge surface 28', the front surface 29 and the upwardly facing channel, represented generally at 30 at, or adjacent the lower end 28" of the panel P as shown in FIG. 2 of the drawings. The upwardly facing channel 30 on the panel P includes the inwardly extending surface 31 with the upwardly extending surface 32 thereon preferably at the inner end of the surface 31 as shown in FIG. 2 of the drawings.

In one method of employing the clip 5 of the present invention, the clip is secured to the uppermost panel UP that is secured to the building siding at desired, longitudinally spaced intervals between about 18 and 28 inches, generally, along the longitudinal extent of the uppermost panel.

The upwardly facing channel 16 of the clip 5 is secured with the uppermost panel UP by engaging the upwardly extending surface 20 in the downwardly facing channel 22 of the uppermost panel UP as shown in FIGS. 1 and 2. This also positions the upwardly facing channel 23 on the uppermost panel UP in the upwardly facing channel 16 of the clip 5 as seen in FIGS. 1 and 2.

The clip 5 is then secured to the building siding 25 by suitable securing means, such as nails 15' which may be extended through the openings 15 or through the slots or openings 24 of the uppermost panel UP.

The top out panel, having been cut to span the uncovered gap between the uppermost panel and the soffit is then abutted at its upper end 28' against the inner surface of the soffit as shown in FIG. 2 of the drawings.

The upwardly facing channel 30 of the top out panel P is positioned so that the upwardly extending surface 32 of the upwardly facing channel 30 extends into the downwardly facing channel 22 between the inner surface 34 of the downwardly facing channel 22 and the snare means 21 on the clip 5.

The flexibility of the vinyl enables the snare means 21 to grasp the inner surface 35 of the upwardly extending surface 32 of the channel 30 of the top out panel and secure it in place. The snare means 21 resist reverse movement of the upwardly extending surface 32 to disengage from the clip 5, or from retracting out of the downwardly facing channel 22.

The foregoing disclosure and description are illustrative and explanatory thereof, and various changes in size, shape and materials as well as in the details of the illustrated construction may be made without departing from the spirit of the invention.

What is claimed is:

1. A clip for engaging and securing an upwardly extending surface of a building siding top out panel between an uppermost siding panel and a soffit of a building, and wherein the uppermost siding panel has a downwardly facing channel with an inner surface thereon and an upwardly facing channel, said clip comprising:

a strip of material;

said ship of material having an upper portion;

at least one opening in said upper portion of said strip of material;

said strip of material having a lower portion;

said strip of material including an upwardly facing channel with an upwardly facing surface thereon in said lower portion of said strip of material to receive the downwardly facing channel and the upwardly facing channel of the uppermost siding panel therein;

projections on said upwardly facing surface of said upwardly facing channel on said strip of material to engage and secure the top out panel upwardly extending surface between the projections and the inner surface of the downwardly facing channel of the uppermost panel.

2. A method of employing a clip to secure a top out panel between an upper most panel and a soffit of a building wherein the top out panel has an upwardly extending surface, the clip has an upwardly facing channel with an upwardly extending surface having upwardly extending projections thereon, and the upper most panel has a downwardly facing channel with an inner surface thereon and an upwardly facing channel comprising the steps of:

securing the uppermost panel to the building;

positioning the downwardly facing and upwardly facing channels of the upper most panel in the upwardly facing channel of the clip, and securing the clip to the building;

abutting the top out panel with the soffit; and positioning the top out panel between the upwardly extending projections on the upwardly facing surface of the upwardly facing channel of the clip and the inner surface of the downwardly facing channel of the uppermost panel.

* * * * *